US008097097B2

(12) United States Patent
Inoue et al.

(10) Patent No.: US 8,097,097 B2
(45) **Date of Patent: *Jan. 17, 2012**

(54) STAINLESS STEEL HAVING A HIGH HARDNESS AND EXCELLENT MIRROR-FINISHED SURFACE PROPERTY, AND METHOD OF PRODUCING THE SAME

(75) Inventors: Yoshiyuki Inoue, Yonago (JP); Fumio Tohyama, Matsue (JP)

(73) Assignee: Hitachi Metals Ltd., Tokyo (JP)

( * ) Notice: Subject to any disclaimer, the term of this patent is extended or adjusted under 35 U.S.C. 154(b) by 419 days.

This patent is subject to a terminal disclaimer.

(21) Appl. No.: 12/341,487

(22) Filed: Dec. 22, 2008

(65) Prior Publication Data

US 2009/0110588 A1 Apr. 30, 2009

Related U.S. Application Data

(63) Continuation of application No. 11/353,976, filed on Feb. 15, 2006, now Pat. No. 7,513,960.

(30) Foreign Application Priority Data

Mar. 10, 2005 (JP) ..... 2005-067807

(51) Int. Cl.
*C22C 38/50* (2006.01)
*C22C 38/34* (2006.01)
*C21D 6/02* (2006.01)

(52) U.S. Cl. ..... 148/326; 148/328; 148/548; 148/607; 148/622; 420/51; 420/103; 420/109; 420/118

(58) Field of Classification Search ..... 148/325–328, 148/333–335, 548, 622, 607; 420/49–51, 420/117, 118, 103, 109
See application file for complete search history.

(56) References Cited

U.S. PATENT DOCUMENTS 5,202,089 A 4/1993 Norstrom et al.

(Continued)

FOREIGN PATENT DOCUMENTS

DE 3628862 3/1987

(Continued)

OTHER PUBLICATIONS

Machine-English translation of Japanese 11-293410, Shimizu Takayasu et al., Oct. 26, 1999.*

(Continued)

*Primary Examiner* — Deborah Yee
(74) *Attorney, Agent, or Firm* — Sughrue Mion, PLLC

(57) ABSTRACT

Disclosed is a stainless steel containing, by mass, 0.05% or less carbon, 1.5 to smaller than 3.5% Si, 3.0% or less Mn, 6.0 to 12.0% Cr, 4.0 to 10.0% Ni, 10.0% or less Co, 6.0% or less Cu, 0.5 to 3.0% Ti, 0 to 2.0% Al, less than 0.4% Mo, not more than 0.01% nitrogen, and the balance of Fe and unavoidable impurities. Preferably, it has a hardness of not lower than 59 HRC and may contain not more than 1.0% Nb and/or not more than 1.0% Ta. Alternatively, the stainless steel may further contain not more than 0.1% of Zr. The process for producing the steel includes producing a steel having a composition as described above by a consumable electrode remelting process, and then subjecting the steel to a solution treatment at a temperature of 1000 to 1150° C. and an aging treatment at a temperature of 400 to 550° C., thereby aging the stainless steel to a hardness of not lower than 59 HRC.

6 Claims, 4 Drawing Sheets

No. 1
(Invention Specimen)

U.S. PATENT DOCUMENTS

| | | | | |
|---|---|---|---|---|
| 6,767,414 | B2 | 7/2004 | Uehara et al. | |
| 7,513,960 | B2 * | 4/2009 | Inoue et al. | 148/326 |

FOREIGN PATENT DOCUMENTS

| | | | |
|---|---|---|---|
| EP | 1 352 980 | | 10/2003 |
| EP | 1352980 | A1 * | 10/2003 |
| JP | 46-9536 | | 3/1971 |
| JP | 5481115 | | 6/1979 |
| JP | 56-108860 | | 8/1981 |
| JP | 60-152660 | | 8/1985 |
| JP | 63-057745 | | 3/1988 |
| JP | 11-293410 | * | 10/1999 |
| JP | 2001-107194 | | 4/2001 |
| JP | 2004-002951 | A1 | 1/2004 |
| WO | 02/48416 | A | 6/2002 |

OTHER PUBLICATIONS

Computer-generated English translation of Japanese patent 2001-107194, Shimizu Takayasu et al., Apr. 17,2001.

* cited by examiner

No. 1
(Invention Specimen)

No. 2
(Invention Specimen)

No. 3
(Invention Specimen)

No. 12
(Comparative Specimen)

JIS SUS440C
(SINTERED SPECIMEN)

No. 3
(INVENTION SPECIMEN)

20 μ m

No. 12
(COMPARATIVE SPECIMEN)

STAINLESS STEEL HAVING A HIGH HARDNESS AND EXCELLENT MIRROR-FINISHED SURFACE PROPERTY, AND METHOD OF PRODUCING THE SAME

CROSS REFERENCE TO RELATED APPLICATIONS

This application is a continuation of application Ser. No. 11/353,976 filed Feb. 15, 2006, now U.S Pat. No. 7,513,960 issued Apr. 7, 2009, claiming priority of Japanese Patent Appln. 2005/067807, filed Mar. 10, 2005, the disclosures of which are hereby incorporated by reference.

TECHNICAL BACKGROUND

The present invention relates to a stainless steel optimal to a corrosion- and wear-resistant die or the like used in a super-mirror-finished formation of resin parts and glass parts (particularly, such as optical disks and optical lenses) required to have an extremely high surface accuracy, which stainless steel, having excellent corrosion resistance property, is improved in the mirror-finished surface property, and to a method of producing the same.

Dies formed from a stainless steel of JIS SUS420J2 or the like by machining or grinding have been used in the fields of forming optical disks (e.g. CDs or DVD media) made of resin, optical lenses made of resin or glass, or the other optical parts (e.g. liquid crystal light-guide plates) made of resin. In the case of optical parts and so on made of resin, which are required to have an extremely high accuracy, a steel corresponding to the above mentioned JIS SUS420J2 have been sometime subjected to plating of amorphous Ni—P followed by machining with utilization of a diamond cutting tool to finish a forming surface in some cases after the amorphous plating thereof. Sometime a Cu alloy with a small amount of impurities has been likewise finished by machining.

On the other hand, there have been known a JIS SKD11 system steel and a JIS SUS440C system steel according to which the both properties of high corrosion resistance and high hardness can be compatibly realized. Further, there has been proposed, for example, a precipitation hardening stainless steel containing not more than 0.08 mass % (herein after merely referred to as "%") of carbon, 2.0 to 5.0% of Si and 6.0 to 10.0% of Cr has been proposed. According to JP-A-2001-107194 (herein after referred to as Patent Document 1), the precipitation hardening stainless steel is further improved to attain a higher hardness by adding an appropriate amount of one or more of Mn, Ni, Mo, Cu, Nb, Ta, Ti and Co.

BRIEF SUMMARY OF THE INVENTION

Among the above-described dies for forming the optical disk or the optical parts, the die made of the stainless steel of JIS SUS420J2 is advantageous in the point that certain levels of corrosion resistance property and high hardness can be obtained, but has problems that its maximum hardness is at most 55 HRC and the wear resistance property is unsatisfactory when used repeatedly. The dies with the Ni—P plating or made of the Cu alloy are disadvantageous in stable forming operations for a long term because of a further lower hardness.

There is also a problem that dies made of the stainless steel of JIS SUS420J2 are not so satisfactory in the corrosion resistance property in the case where they are used in forming optical disks while water-cooling the dies, or in resin forming during which a corrosive gas is generated, and where they are used in a mass production for a long term. Further, the dies made of the stainless steel of JIS SUS420J2 have a problem that they are difficult to obtain an exactly smooth mirror surface since JIS SUS420J2 has a microstructure containing large precipitates of chromium carbide having a size of a micron level. This will be a big problem to realize a next-generation high-density optical disk which is intended to have an average surface roughness of a sub-nanometer level.

On the other hand, with regard to melting/casting steels of a JIS SKD11 system or a JIS SUS440C system, or steels of powder metallurgy, having been conventionally used in applications in which a high hardness (not less than 58 HRC) and a corrosion resistance property are required, dies made of them are also unsatisfactory when used in forming optical disks while water-cooling the dies, or in resin forming during which a corrosive gas is generated, and when they are used in a mass production for a long term. An improvement will be needed for these materials in super-mirror-finishing property since they contain hard alloyed carbides.

The improved steel disclosed in Patent Document 1 is a material more excellent than the conventional steel with respect to the compatible properties of high corrosion resistance and high hardness, but the attainable maximum hardness thereof is limited to around 58 HRC even in the case of a small billet of a round bar having a diameter of 20 mm which has been subjected to a solution treatment under a cooling condition of water quenching which is favorable for obtaining a high hardness of the material. It is difficult to produce actual dies for forming optical disks or optical parts taking cooling conditions of the solution treatment into consideration, regarding which cooling conditions slow cooling (such as air-cooling) is desirable in order to restrain occurrence of thermal strain. In the case of the improved steel disclosed in Patent Document 1, if a die is produced from the steel under the above producing conditions, an attainable hardness thereof will be indeed less than 58 HRC.

Further, while the mirror surface property of the improved steel shown in Patent Document 1 is superior than that of conventional steels, it has a metal structure containing a lot of precipitates of the Laves phases which is softer than carbides. Taking into consideration that it is an important factor for attaining excellent mirror surface property of the die to obtain a metal structure having a high hardness, a further improvement will be needed for the improved steel shown in Patent Document 1 when the die is used for forming optical disks or optical parts, which die is required to have excellent mirror-finishing surface property.

An object of the present invention is to provide a stainless steel having a high hardness and excellent mirror-finishing surface property and a method of producing the same, which steel is optimal especially in the technical field of producing tools and parts including dies for forming resin- or glass-parts which are required to have an extremely high surface accuracy.

Under the above background, the present inventors found a stainless steel which contains an optimal amount of Si, in which an amount of Mo is controlled, and which can be most suitably applied to a particular die material as mentioned above, the die material being required to have excellent corrosion resistance property, a high hardness and especially an extremely smooth mirror surface after forming, wherein such an extremely smooth mirror surface is an unprecedented property in other die applications. According to the thus found stainless steel having a specific chemical composition, a high hardness of not less than 59 HRC even in the case of slow cooling condition, such as air-cooling, in the solution treatment, or of up to 61 HRC in the case of quenching, such as water-cooling, in the solution treatment. Further, the present inventors found that the stainless steel is most suitably produced by a consumable electrode remelting method in order to bring out the invention advantageous effects mentioned above.

Thus, according to a first aspect of the invention, there is provided a stainless steel having a high hardness and an excellent mirror-finished surface property, which consists of, by mass, from more than zero to not more than 0.05% C (carbon), from 1.5 to less than 3.5% Si, from more than zero to not more than 3.0% Mn, 6.0 to 12.0% Cr, 4.0 to 10.0% Ni, from more than zero to not more than 10.0% Co, from more than zero to not more than 6.0% Cu, 0.5 to 3.0% Ti, from zero to not more than 2.0% Al, optionally at least one element selected from the group consisting of three elements of not more than 1.0% Nb, not more than 1.0% Ta and not more than 0.1% Zr, up to the limit of 1.0% Mo, up to the limit of 0.01% N (nitrogen), and Fe and unavoidable impurities. Preferably, the Si amount is restricted to a range of from 2.0 to less than 3.0%, or further the Mo amount is restricted to not more than 0.5%. Preferably, the stainless steel has a hardness of not less than 59 HRC.

According to a second aspect of the invention, there is provided a method of producing a stainless steel having a high hardness and excellent mirror-finished surface property, which comprises the steps of:

preparing a work of the stainless steel obtained by a consumable electrode re-melting process, the stainless steel consisting of, by mass, from more than zero to not more than 0.05% C (carbon), from 1.5 to less than 3.5% Si, from more than zero to not more than 3.0% Mn, 6.0 to 12.0% Cr, 4.0 to 10.0% Ni, from more than zero to not more than 10.0% Co, from more than zero to not more than 6.0% Cu, 0.5 to 3.0% Ti, from zero to not more than 2.0% Al, optionally at least one element selected from the group consisting of three elements of not more than 1.0% Nb, not more than 1.0% Ta and not more than 0.1% Zr, up to the limit of 1.0% Mo, up to the limit of 0.01% N (nitrogen), and Fe and unavoidable impurities; and subjecting the work to heat treatment so as to make it to have a hardness of not less than HRC 59.

Preferably the heat treatment includes solution treatment at a temperature of 1,000 to 1,150° C., and aging treatment at a temperature of 400 to 550° C.

According to the present invention, the super-mirror-finished surface property and the wear resistance property of the stainless steel having the high hardness and the excellent corrosion resistance property can be significantly improved. Thus, especially the stainless steel can be advantageously applied to dies as an indispensable means for realizing a long-term stable formation of resin or glass parts requiring an extremely high surface accuracy such as optical disks or optical lenses.

Figure 1:
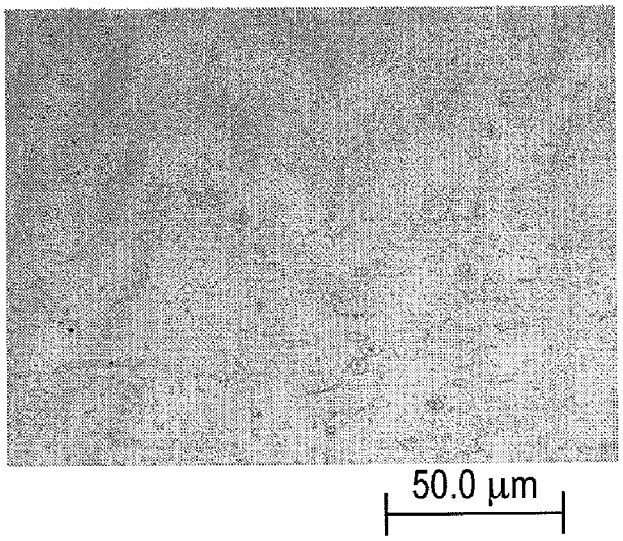
FIG. 1 is a microphotograph showing one example of microstructure of a steel according to the present invention.

As stated above, important features of the present invention are that the stainless steel is excellent in the corrosion resistance property, and contains the optimal amount of Si, and other selected alloying elements each having an optimal amount, that the stainless steel is a result of re-evaluation of Mo with regard to effects or functions, whereby obtaining a high hardness and super-mirror-finished surface property while significantly improving wear resistance property, and that the producing method of the stainless steel is optimal.

DETAILED DESCRIPTION OF THE INVENTION

Herein below, there will be provided a description of alloy components of the invention stainless steel.

As mentioned above, if a stainless steel relies on the precipitation effect of hard carbides in the metal structure in order to highly harden it, it is difficult to obtain a super mirror-finished surface property of the steel. Thus, in the invention stainless steel, intermetallic compounds moderately softer than carbides are finely precipitated in the metal structure of the stainless steel, and the carbides are reduced in amount and finely dispersed thereby providing a super mirror-finished surface property and a high hardness. For this purpose, the adjustment of the carbon amount in the stainless steel is important. By controlling the carbon amount to 0.05% or less, the amount of the hard carbides in the steel structure can be reduced, and the size of carbides precipitated can be restricted to the order of submicron, thereby realizing a super-mirror-finished surface property. The carbon amount is preferably not more than 0.02%, and more preferably lower than 0.01%.

Si is a primary element in order to provide the strength to the invention stainless steel, and an essential element for realizing the mirror-finished surface property, which is important for utilization even to die applications supposed by the present invention. Namely, an excellent mirror-finished surface property is provided by the contribution of Si to a precipitation strengthening mechanism in which Si forms the G-phase together with Cr, Ni, Co and Ti without recourse to a conventional precipitation strengthening mechanism provided by carbides Si dissolved in the matrix also has an effect of enhancing the corrosion resistance property (particularly, a resistance to sulfuric acid). If the Si amount is lower than 1.5%, the effect thereof is insufficient, but if the Si amount is equal to or higher than 3.5%, many Laves phases as large as on the order of several ten microns are precipitated, and they themselves deteriorate the mirror-finished surface property, and Si and other strengthening elements are also caught into the Laves phases. For this reason, even if an excessive amount of Si is added, no effect is provided. Therefore, in the present invention, the Si amount is restricted to a range of 1.5 to lower than 3.5%. Preferably, the Si amount is in a range of 2.0 to 3.0%.

Mn acts as a deoxidizing agent for the steel and is preferred to be contained in an amount of not less than 0.05%. If the Mn amount is too large, the amount of austenite in the metal structure is too increased, and as a result, it is difficult to provide a predetermined hardness. Therefore, the Mn amount is set at not more than 3.0%, preferably at not more than 0.8%.

Cr is an indispensable element for ensuring the corrosion resistance property of the stainless steel, and if the application of the present invention to the dies is taken into consideration, if the Cr amount is lower than 6.0%, the corrosion resistance property is insufficient. Cr forms the G-phase together with Si, Ni, Co and Ti to contribute to the strengthening of precipitation. However, if the Cr amount exceeds 12.0%, it is difficult to provide a predetermined hardness, desirably, a hardness equal to or higher than 59 HRC. For this reason, the Cr amount is set in a range of 6.0 to 12.0%.

Ni is an element which provides the corrosion resistance property to the steel and which has a function, under a balanced relationship between Ni and Cr contents, to provide the phase transformation to a desirable form, i.e., from a single phase of austenite to a single phase of low-carbon martensite during cooling in the solution thermal treatment. Ni also forms the G-phase together with Si, Cr, Co and Ti to contribute to the strengthening of precipitation. However, if the Ni amount is too large, the amount of austenite is too increased and as a result, it is difficult to provide a predetermined hardness. Therefore, the Ni amount in the present invention steel is set in a range of 4.0 to 10.0%.

Co is an important element which forms the G-phase together with Si, Cr, Ni and Ti and contributes to the strengthening of precipitation, in addition to the improvement of the corrosion resistance property. However, the excessive content of Co causes the machinability to be detracted and hence, the Co amount is set at not more than 10.0%.

Cu contributes to the precipitation hardening in the aging after the solution treatment and enhances the corrosion resistance property. However, the excessive content of Cu causes the machinability to be detracted and hence, Cu is also an important element for controlling the restriction. In the present invention, the Cu amount is set at not more than 6.0%, but desirably set at not more than 2.0% in order to accommodate the size of a material required for an actual die.

Ti is one of primary elements which contribute to the age hardening in the heat treatment of the hardness by the solution treatment and the aging treatment. Namely, Ti is an important element which forms the G-phase together with Si, Cr, Ni and Co and contributes to the precipitation strengthening. Therefore, Ti is contained in an amount equal to or higher than 0.5%. However, if an excessive amount of Ti is contained, the toughness is detracted and further, the amount of Laves phases as large as the order of several tens microns is increased. Moreover, Laves phases deteriorate the mirror-finished surface property, and Ti and the other strengthening elements are caught into the Laves phases. For this reason, the addition of the excessive amount of Ti provides no effect. Further, the excessive amount of Ti causes carbides, nitrides and the like to be formed, thereby exerting an adverse effect to the mirror-finished surface property. Therefore, in the present invention, the Ti amount is set in a range of 0.5 to 3.0% and desirably in a range of 1.0 to 2.5%.

Al is an element acting as a deoxidizer for the steel. More specifically, the strengthening mechanism employed in the present invention does not rely on the inclusion of hard carbides, and contrasting, the carbides exert an adverse effect to the mirror-finished surface property. For this reason, it is necessary to reduce the amount of the carbides and hence, the carbon amount is restricted to 0.05% or less and desirably to lower than 0.01%. Therefore, the deoxidization by carbon is not performed and hence, the deoxidization by Al is effective. However, since the excessive amount of Al contained deteriorates the toughness, the Al amount in the present invention is set at not more than 2.0% and desirably at not more than 0.5%.

On the other hand, since there is a concern that Al forms $Al_2O_3$ or composite oxides of Al/Mg to deteriorate the stainless steel in the mirror-finishing surface property, it is desirable to remove Al from a deoxidized molten steel so as to be as small as possible. Alternatively, it is possible to omit the aluminum-deoxidizing process itself by positively making use of the consumable electrode type remelting method.

Mo is an element which is conventionally added as enhancing the corrosion resistance property and contributing to the age hardening in the heat treatment. However, as the Mo is added, the amount of Laves phases as large as the order of several tens microns is increased, which causes the mirror-finished surface property to be deteriorated. The other strengthening elements in addition to the Mo are caught into the Laves phases, thereby exerting an adverse effect to the increasing of the hardness. Therefore, in the present invention, it is important that the Mo amount is restricted to not more than 1.0%. Desirably, the Mo amount is set to not more than 0.5% and more desirably to lower than 0.4%.

Nitrogen forms nitrides and carbon nitrides together with Ti and the like to exert an adverse effect to the mirror-finished surface property. For this reason, it is necessary to restrict the amount of nitrogen to not more than 0.01%. Desirably, the amount of nitrogen is restricted to not more than 0.005% and more desirably to not more than 0.003%.

What is especially important in the composition of constituents of the present invention is the composite control of the amounts of Si and Mo, such that the Si amount is controlled in a lower range, and the amount of Mo is restricted. Namely, the precipitation of the large Laves phases can be suppressed by reviewing the functional effect of Mo to restrict the Mo amount to not more than 1.0% and by finding a range of optimal amounts of Si of 1.5 to lower than 3.5%. A sufficient service hardness and specifically a higher hardness of 59 HRC can be achieved by the air-cooling condition without utilization of the water-cooling and the oil-cooling for the cooling condition in the solution treatment, and the thermal treatment strain which is a problem can be also reduced. Of course, the water-cooling and the oil-cooling may be utilized and in this case, a further higher hardness reaching 61 HRC can be achieved.

The invention stainless steel may contain Nb and/or Ta, as required. Nb has an effect of increasing the hardness of the stainless steel provided by the aging treatment, but if an excessive Nb amount is contained, the amount of Laves phases as large as the order of several tens microns is increased, whereby the mirror-finished surface property is likewise deteriorated, and Nb and other strengthening elements are caught into the Laves phases. For this reason, the addition of the excessive amount of Nb provides no effect. Therefore, the Nb amount, provided it is added or contained, is desirable to be not more than 1.0%, more desirable, to be not more than 0.5%. To provide the above-described effect, it is desirable that the Nb amount is equal to or larger than 0.1%.

Ta has an effect of increasing the hardness of the stainless steel provided by the aging treatment, as does Nb, but the containing of an excessive amount of Ta likewise causes an adverse effect to the mirror-finished surface property. Therefore, the Ta amount, provided it is added or contained, is desirable to be not more than 1.0%, more desirable, to be not more than 0.5%. To provide the above-described effect, it is desirable that the Nb amount is equal to or larger than 0.1%.

Further, the invention stainless steel may contain Zr, as required. Zr has an effect of preventing the generation of pinholes by replacing $Al_2O_3$ and Al/Mg composite oxides causing pinholes during mirror-finishing by $ZrO_2$. However, if an excessive amount of Zr is contained, the amount of Lave phases as large as the order of several tens microns and the amount of Zr-based inclusions are increased, whereby the mirror-finished surface property is likewise deteriorated. Therefore, the Zr amount, provided it is added or contained, is desirable to be not more than 0.1%, more desirable, to be not more than 0.08%, but to provide the above-described effect, it is desirable that the Nb amount is equal to or larger than 0.01%.

Further, as described above, according to the present invention, it is desirable that a stainless steel having a hardness equal to or larger than 59 HRC is employed. The present invention has an important feature in that the hardness of such level has been achieved. The hardness equal to or larger than 59 HRC ensures that it is difficult to flaw the surface of the stainless steel during rough polishing for mirror-polishing, and that the mirror-finishing is facilitated and at the same time, the wear resistance property can be improved. To achieve such a high hardness, the above-described composition of constituents for the stainless steel is an important factor. Therefore, if the invention stainless steel is applied for a die for forming a product requiring an extremely high surface accuracy such as resin and glass parts, a forming surface of the die having a hardness of the above-described level after heat treatment and machining such as cutting or grinding/polishing and lapping has an excellent super-mirror-finished surface property and a wear resistance property during molding.

It is desirable that the invention stainless steel is one produced, for example, by a consumable electrode remelting process, in addition to the above-described composition of constituents for forming the stainless steel. More specifically, the invention stainless steel produced by carrying out the consumable electrode remelting process such as a vacuum arc remelting process (VAR) and an electro-slug remelting process (ESR) contains a reduced amount of non-metal inclusions such as alumina causing the generation of pinholes during the mirror-finishing at the time point when the stainless steel is to be subjected to the machining, and hence, a more stable super-mirror-finished surface property can be realized. The consumable electrode remelting process may be conducted one time or a plurality of times, and a thus-produced ingot may be subjected to a hot working by a forging, a rolling or the like.

In order to subject the ingot having the invention chemical composition to a heat treatment to produce a stainless steel having an excellent mirror-finishing surface property and a high hardness equal to or higher than 59 HRC, it is desirable that an aging treatment at a temperature in a range of 400 to 550° C. is carried out after a solution treatment at a temperature in a range of 1000 to 1150° C. In the solution treatment at a temperature lower than 1000° C., Laves phases are not dissolved, which exert an adverse effect to the mirror-finished surface property and the increasing of hardness. In the solution treatment at a temperature exceeding 1150° C., crystal grains are coarsened, resulting in a reduction in toughness. In the aging treatment at a temperature lower than 400° C., no precipitation strengthening phase is precipitated and for this reason, it is difficult to provide a hardness equal to or higher than 59 HRC. In the aging treatment at a temperature exceeding 550° C., an over-aging occurs and for this reason, it is likewise difficult to provide a hardness equal to or higher than 59 HRC. In the tempering carried out in the present invention, the aging treatment may be carried out after a subzero treatment carried out after the solution treatment.

EXAMPLE 1

To show the effect of the invention stainless steel, in this Example 1, the evaluation is provided for a case where a water-cooling conventionally utilized under cooling conditions for a solution treatment is utilized. First, an ingot produced by the melting in a vacuum induction furnace (a specimen No. 4 was produced by the melting by a vacuum arc remelting process) was subjected to a hot working, thereby preparing specimens (having a size of 15×14×30 mm) comprising chemical constituents (% by mass) given in Table 1, a balance of Fe and unavoidable impurities. These specimens were subjected to the heat treatment process involving the solution treatment (at 1100° C.), the subzero treatment (at −78° C.) and the aging treatment (480° C.), and the achieved hardness of each of the specimens was evaluated. Specimen No. 10 was a large-sized specimen produced by subjecting the ingot resulting from the vacuum arc remelting to the hot working to provide an ingot having a diameter of 200 mm, and then tempering the ingot by the solution treatment (at 1100° C.) and the aging treatment (at 490° C.). Specimen No. 11 was a big size one which was produced by substantially the same way as specimen No. 10 except for that specimen No. 11 was not subjected to aluminum deoxidizing. Specimen Nos. 10 and 11 were used for the evaluation in Examples 2 and 3 which will be described hereinafter.

The cooling in the solution treatment was carried out under a cooling condition regulated to a cooling speed corresponding to a half-cooling time of 15 minutes in addition to the water-cooling. The half-cooling time is understood to mean a cooling conducted for a time required to cool the specimen from a solution treatment temperature to a temperature which is one half of (the solution treatment temperature+room temperature). In Example 1, a condition of half-cooling time of 15 minutes was also utilized, which corresponds to a cooling speed provided in the oil-cooling of a steel material having a diameter of 300 mm when the invention stainless steel was utilized for an actual die. The obtained hardness of each specimen is given in Table 2. The micro-structures of specimen Nos. 1, 2, 3 and 12 provided after the aging treatment utilizing the half-cooling time of 15 minutes are respectively shown in FIGS. 1 to 4.

TABLE 1

| | Specimen | Chemical Composition (% by mass) | | | | | | | | | | | | | |
|---|---|---|---|---|---|---|---|---|---|---|---|---|---|---|---|
| | No. | C | Si | Mn | Ni | Cr | Mo | Co | Cu | Nb | Al | Ti | Ta | Zr | N |
| Invention specimen | 1 | 0.010 | 2.5 | 0.5 | 6.4 | 10.2 | 1.0 | 7.9 | 1.0 | - | 0.08 | 2.0 | - | - | 0.002 |
| | 2 | 0.008 | 2.5 | 0.5 | 6.4 | 10.3 | 0.5 | 7.9 | 1.0 | - | 0.07 | 2.1 | - | - | 0.004 |
| | 3 | 0.007 | 2.5 | 0.5 | 6.4 | 10.3 | - | 7.9 | 1.0 | - | 0.07 | 1.9 | - | - | 0.002 |
| | 4 | 0.006 | 2.5 | 0.5 | 6.5 | 10.3 | - | 8.0 | 1.0 | - | 0.10 | 2.0 | - | - | 0.001 |
| | 5 | 0.007 | 2.4 | 0.5 | 6.5 | 10.4 | - | 7.9 | 1.0 | 0.3 | 0.08 | 1.9 | - | - | 0.002 |

TABLE 1-continued

| | Specimen No. | Chemical Composition (% by mass) C | Si | Mn | Ni | Cr | Mo | Co | Cu | Nb | Al | Ti | Ta | Zr | N |
|---|---|---|---|---|---|---|---|---|---|---|---|---|---|---|---|
| | 6 | 0.008 | 2.7 | 0.5 | 6.5 | 10.3 | - | 8.0 | 1.0 | - | 0.07 | 1.9 | 0.5 | - | 0.002 |
| | 7 | 0.005 | 2.5 | 0.5 | 6.3 | 10.1 | 0.1 | 7.9 | 1.0 | - | 0.09 | 2.0 | - | 0.07 | 0.001 |
| | 8 | 0.005 | 2.6 | 0.5 | 6.5 | 10.2 | - | 8.0 | 1.0 | - | 0.10 | 2.5 | - | - | 0.001 |
| | 9 | 0.005 | 2.5 | 0.5 | 6.6 | 10.3 | - | 8.0 | 2.0 | - | 0.10 | 2.0 | - | - | 0.001 |
| | 10 | 0.006 | 2.6 | 0.3 | 6.7 | 10.2 | - | 8.0 | 0.9 | - | 0.12 | 2.0 | - | - | 0.001 |
| | 11* | 0.003 | 2.7 | 0.3 | 6.5 | 10.2 | - | 8.2 | 0.9 | - | 0.003 | 2.1 | - | - | 0.001 |
| Comparative specimen | 12 | 0.007 | 3.6 | 0.5 | 6.4 | 10.3 | 1.5 | 6.0 | 1.0 | 0.5 | 0.01 | 1.4 | - | - | 0.002 |
| | 13 | 0.010 | 1.9 | 1.0 | 6.5 | 10.4 | 1.5 | 5.1 | 1.0 | - | 0.001 | 0.7 | 0.7 | - | 0.001 |
| | 14 | 0.009 | 2.7 | 0.5 | 6.5 | 10.4 | 1.6 | 8.1 | 1.0 | - | 0.08 | 2.0 | - | - | 0.002 |

*The hyphen "-" means "less than 0.01%".
*Comparative specimen

TABLE 2

| Condition of solution treatment | | Hardness (HRC) of Specimen Nos. 1-14 1 | 2 | 3 | 4 | 5 | 6 | 7 | 8 | 9 | 12 | 13 | 14 |
|---|---|---|---|---|---|---|---|---|---|---|---|---|---|
| Cooling condition | Half-cooling time of 15 minutes | 60.3 | 60.5 | 60.5 | 60.6 | 60.0 | 60.1 | 60.4 | 60.4 | 60.7 | 57.5 | 55.7 | 59.8 |
| | Water-cooling | 60.6 | 60.9 | 60.9 | 61.0 | 60.3 | 60.4 | 60.9 | 60.9 | 61.4 | 58.7 | 56.3 | 60.2 |

Figure 5:
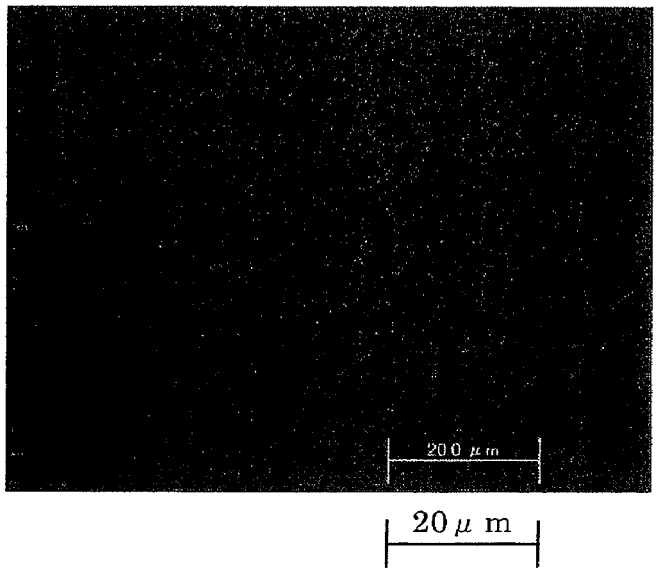
FIG. 5 is a microphotograph showing a mirror-finished surface (a reference mirror-finished surface) of a steel for powder metallurgy corresponding to JIS SUS440C.
Figure 6:
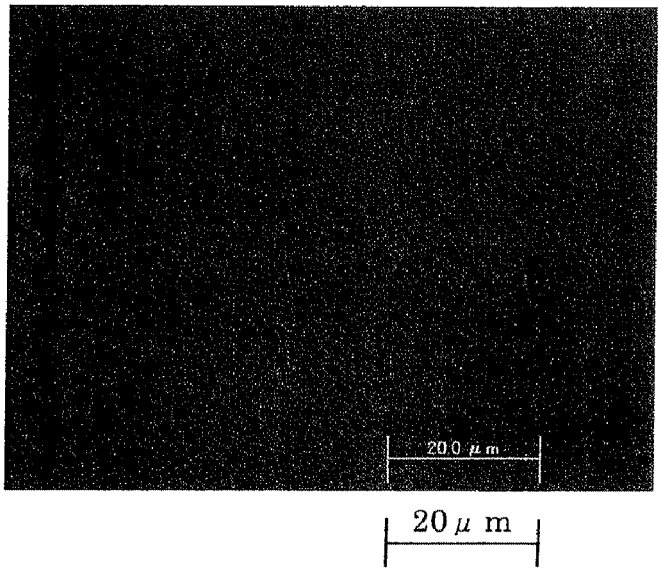
FIG. 6 is a microphotograph showing one example of a mirror-finished surface (evaluated as A) of the steel according to the present invention.
Figure 7:
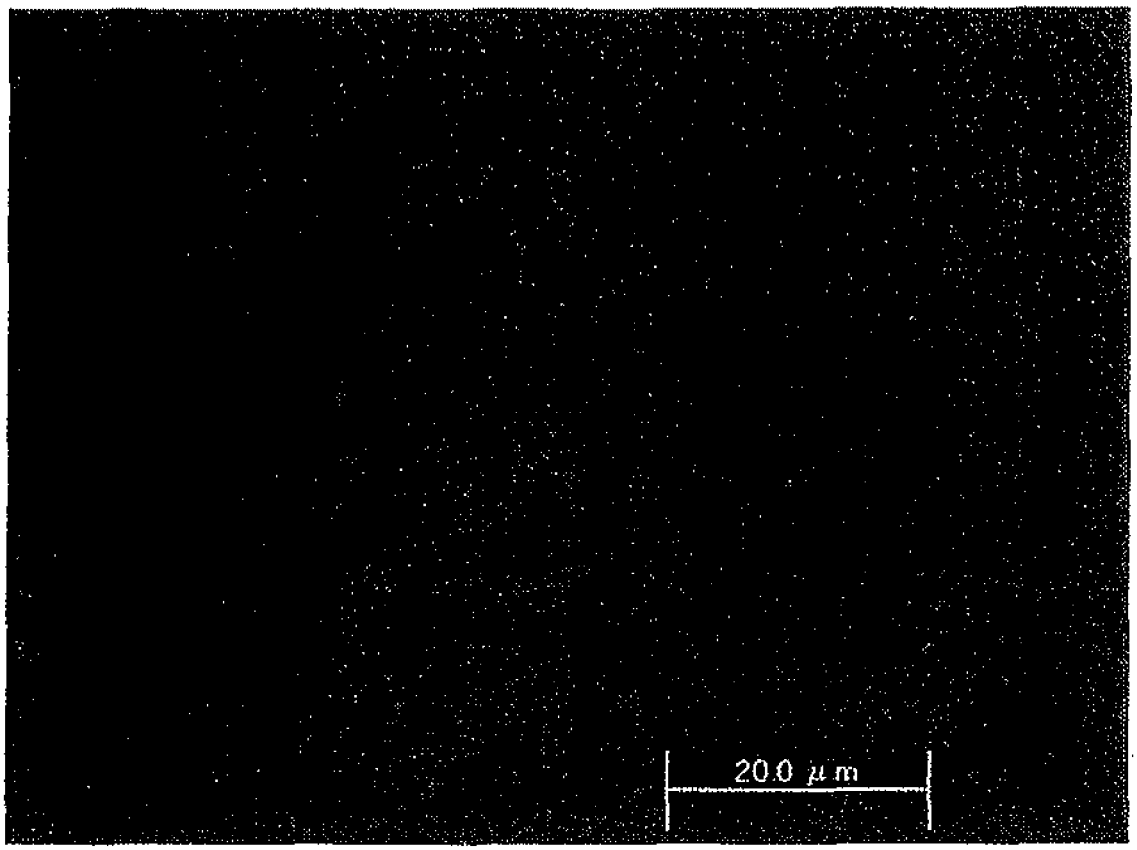
FIG. 7 is a microphotograph showing one example of a mirror-finished surface (evaluated as B) of the comparative steel.

To evaluate the mirror-finished surface property of each specimen having a regulated hardness, the specimen was subjected to mirror-finishing under a condition (for a mirror finishing by alumina) on the supposition of a mirror polishing applied for the working of a forming surface of a die for forming an optical disk, and a mirror-finish level of a surface resulting from the mirror-finishing was evaluated. The mirror-finish level was evaluated on the basis of a mirror-finish level (an enlarged microscopic photograph of 900 magnifications is shown in FIG. 5) of a steel for powder metallurgy (59.8 HRC) corresponding to JIS SUS440C showing a mirror-finish level. In the evaluation, the specimen showing a mirror-finish level more excellent than the basis is shown by "A" (FIG. 6) in Table 2, and the specimen having a mirror-finish level slightly poorer than the basis but acceptable for use is shown by "B" (FIG. 7) in Table 2. Among the specimens prepared in Example 1, there is no specimen having a mirror-finish level as poor as intolerable for use. Results are given in Table 3.

TABLE 3

| Condition of solution treatment | | Evaluation of mirror-finish level 1 | 2 | 3 | 4 | 5 | 6 | 7 | 8 | 9 | 12 | 13 | 14 |
|---|---|---|---|---|---|---|---|---|---|---|---|---|---|
| Cooling condition | Half-cooling time of 15 minutes | A | A | A | A | A | A | A | A | A | B | A | B |
| | Water-cooling | A | A | A | A | A | A | A | A | A | B | A | B |

Figure 2:
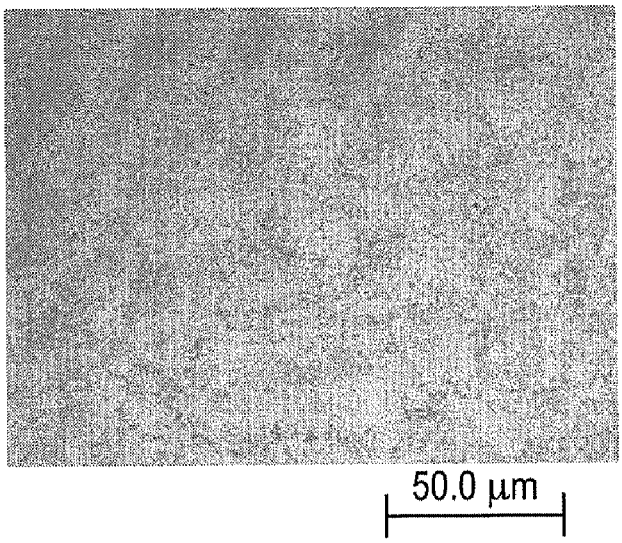
FIG. 2 is a microphotograph showing another example of microstructure of a steel according to the present invention.
Figure 3:
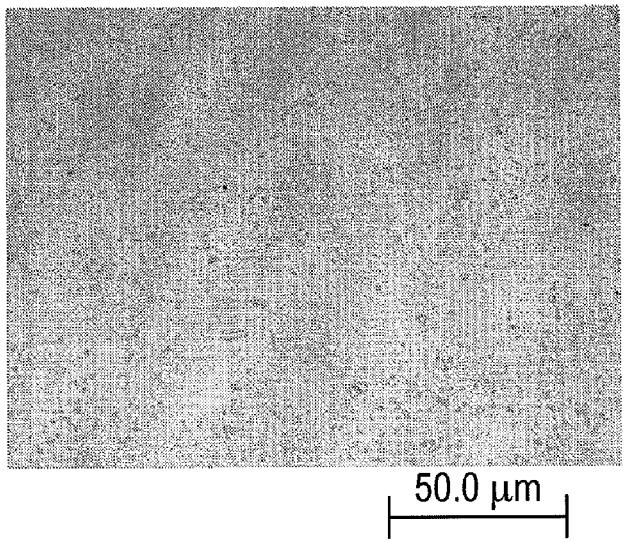
FIG. 3 is a microphotograph showing a further example of microstructure of a steel according to the present invention.

Specimen Nos. 1 to 9 in Table 1 are steels satisfying the present invention, and specimen Nos. 5 and 6 are steels containing Nb and Ta added thereto, respectively. In these specimens, an excellent characteristic of high hardness equal to or higher than 60 HRC was obtained even in the case of the cooling condition in the solution treatment corresponding to that for the half-cooling time of 15 minutes by virtue of the control of the Si amount in a lower range and the restriction of the Mo amount, and in the case of the water-cooling, the hardness of each of specimen Nos. 2, 3 and 4 reached about 61 HRC. Further, in specimen No. 9 subjected to the solution treatment under the cooling condition corresponding to the water cooling, a hardness as high as 61.4 HRC was obtained. Even with specimen Nos. 5 and 6 containing Nb and Ta added thereto, if the solution treatment is carried out at a temperature of 1150° C., a hardness equivalent to those of specimen Nos. 2, 3 and 4 is achieved. In the steels satisfying the present invention, the precipitation of large Laves phases is substantially suppressed by virtue of the employment of the simultaneous control of Si and Mo in accordance with the present invention, as the microstructures of specimen Nos. 1, 2 and 3 are shown in FIGS. 1, 2 and 3, and excellent results were obtained even for the super-mirror-finished surface property, as shown in Table 3.

Figure 4:
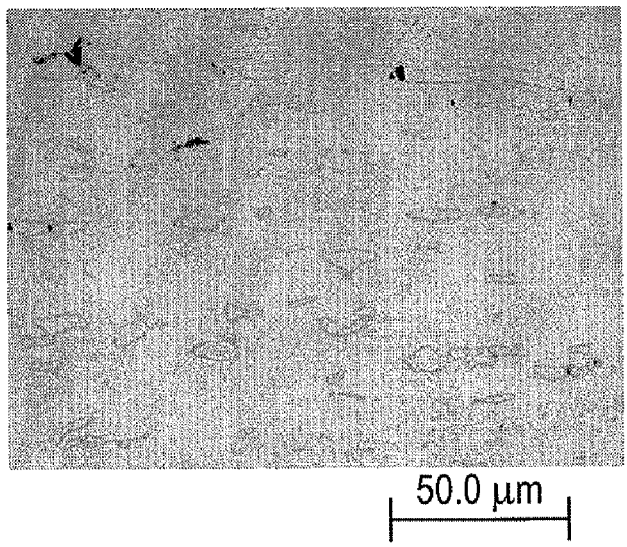
FIG. 4 is a microphotograph showing one example of microstructure of a comparative steel.

Specimen No. 12 has high contents of Si and Mo, but in the case of the cooling condition in the solution treatment corresponding to the half-cooling time of 15 minutes, the hardness of specimen No. 11 is on the order of 57 HRC, and even in the case of the water-cooling, a hardness of 59 HRC could not be achieved. Further, even when the water-cooling was carried out at a temperature raised up to 1150° C. in the solution treatment, it is a limit for the hardness to reach 59 HRC. Specimen No. 11 is more excellent in mirror-finished surface property than the conventional steel such as JIS SUS420J2, but a large number of Laves Phases as large as the order of several tens microns were precipitated in specimen No. 11, as the microstructure is shown in FIG. 4. This degrades the super-mirror-finished surface property, as shown in Table 3.

In specimen Nos. 13 and 14, the Si amount of specimen No. 12 was controlled, but the Mo amount is still larger. In specimen No. 13, the hardness does not reach 57 HRC in the case of the cooling condition corresponding to the water-cooling in the solution treatment, because of the smaller amount of Si and moreover, of the relatively small amount of Ti. In specimen No. 14, a hardness of 59 HRC could be satisfied in the case of the cooling condition corresponding to the half-cooling time of 15 minutes in the solution treatment, and a hardness of 60 HRC could be achieved in the case of the water-cooling, by virtue of the Ti amount larger than that in specimen No. 13. In this way, as regards the hardness, the result sufficiently satisfactory for the application to an actual die was obtained. As regards the mirror-finished surface property, the precipitation of large Laves Phases can be restrained, as compared with specimen No. 12 by the control of the Si amount to a smaller level, but the mirror-finished surface property is insufficient to satisfy a super level, because of a large amount of Mo contained

EXAMPLE 2

In Example 2, the evaluation is made in the case where an air-cooling is utilized for the cooling condition in the solution treatment. This air-cooling serves as an effective cooling condition for restraining the thermal treatment strain in the manufacture of an actual die. For specimen Nos. 2 and 3 in Table 1, the aging treatment (at 480° C.) was carried out after the solution treatment (at 1100° C.). The subzero treatment was not carried out. Utilized as the cooling conditions in the solution treatment are conditions based on a half-cooling time of 15 minutes supposing the oil-cooling of a steel for an actual die (having a diameter of 300 mm) and a half-cooling time of 70 minutes corresponding to a slower cooling speed in the air-cooling of a steel material having a diameter of 200 mm and likewise used for formation of an actual die. A hardness provided in each of the cooling conditions is given in Table 4. For specimen Nos. 10 and 11 having a diameter of 200 mm, the cooling speed corresponds to that in the half-cooling time of 70 minutes from the fact that the air-cooling was utilized for the cooling condition in the solution treatment.

TABLE 4

| | Hardness (HRC) | |
|---|---|---|
| Specimen No. | Half-cooling time of 15 minutes | Half-cooling time of 70 minutes |
| 2 | 60.2 | 59.8 |
| 3 | 60.4 | 60.0 |
| 10 | — | 60.3 |
| 11* | — | 60.1 |

*Comparative specimen

In order to evaluate the mirror-finishing surface property of each of the specimens having the regulated hardness, the mirror-finishing working was carried out, and the mirror-finish level of a surface resulting from the mirror-finishing was evaluated. The evaluation of the mirror-finishing was carried out as in the case of Example 1 on the basis of the mirror-finish level of the steel (of 59.8 HRC) for powder metallurgy corresponding to JIS SUS440C used in Example 1. Results are given in Table 5.

TABLE 5

| Condition of solution treatment | | Evaluation of mirror-finish level | | | |
|---|---|---|---|---|---|
| | | 2 | 3 | 10 | 11* |
| Cooling condition | Half-cooling time of 70 minutes | A | A | A | A |

*Comparative specimen

Specimen Nos. 2 and 3 satisfying the present invention showed results that a hardness equal to or higher than 59 HRC can be achieved without the subzero treatment, as shown in Tables 2 and 4. Further, even at the cooling speed (corresponding to the half-cooling time of 70 minutes) lower than that of the air-cooling in the solution treatment on supposition of an actual die, the hardness equal to or higher than 59 HRC could be achieved. Even in these microstructures, the precipitation of Laves phases as large as the order of several tens microns was restrained as in specimen Nos. 1 to 3 shown in FIGS. 1 to 3, and a super-mirror-finished surface property was also achieved, as shown in Table 5. In specimen No. 10, the air-cooling was actually utilized, but a hardness higher than 60 HRC was obtained. For the microstructure, the precipitation of Laves phases as large as the order of several tens microns was restrained, and a super-mirror-finished surface property was also achieved, as shown in Table 5.

EXAMPLE 3

In Example 3, the evaluation of the corrosion resistance property was carried out for specimen No. 10 (of 60.5 HRC) satisfying the present invention and the steel for powder metallurgy corresponding to JIS SUS440C having a good hardness and a good mirror-finished surface property and used as a comparative specimen. For the evaluation of the corrosion resistance property, a salt spray test and a corrosion weight loss test were carried out. In the corrosion weight loss test, each specimen (having a diameter of 10 mm and a length of 20 mm) was immersed into 200 ml of a solution of 1% by mass of an acid (hydrochloric acid, sulfuric acid and nitric acid) at 50° C. for 4 hours, and a decrease in weight after the immersion was determined as a corrosion weight loss. In Example 3, the evaluation was carried out using a rating number process (JIS-Z-2371-Annexed Document: a method for evaluating the size and number of corrosion defects in an effective surface of each test piece by numerals of 0 to 10, wherein the test piece corroded to exceed a corroded-area rate of 50% is defined as 0, and the test piece not corroded at all is defined as 10), and results are given in Table 6, and results of the corrosion weight loss test are given in Table 7.

TABLE 6

| | Evaluation by the rating number process | | |
|---|---|---|---|
| Specimen | After lapse of 5 hours | After lapse of 24 hours | After lapse of 240 hours |
| Specimen No. 10 | 10 | 10 | 10 |
| Steel for powder metallurgy corresponding to JIS SUS440C | 1 | 0 | 0 |

TABLE 7

| Specimen | Corrosion weight loss ($g/m^2 \cdot h$) | | |
|---|---|---|---|
| | Hydrochloric acid | Sulfuric acid | Nitric acid |
| Specimen No. 10 | 0.5 | 32.6 | 0.0 |
| Steel for powder metallurgy corresponding to JIS SUS440C | 88.2 | 82.2 | 32.1 |

In the results of the salt spray test in Table 6, the steel for powder metallurgy corresponding to JIS SUS440C shows a corroded-area rate exceeding 25% after the lapse of 5 hours from the spraying of a salt solution and a corroded-area rate exceeding 50% after lapse of 24 hours or more. However, it can be seen that specimen No. 10 of the present invention was not corroded at all even after the lapse of 240 hours and has an excellent corrosion resistance property. In the corrosion weight loss test in Table 7, it can be seen that specimen No. 10 of the present invention has a corrosion resistance to each of the acids, as apparent, as compared with the steel for powder metallurgy corresponding to JIS SUS440C.

The stainless steel of the present invention having the high corrosion resistance property and the mirror finished surface property and the high hardness is applicable to a die for forming a so-called super-engineering plastic such as a PPS resin containing a reinforcement material such as a glass fiber requiring a similar characteristic, in addition to the die for forming the optical disk and the optical lens. The stainless steel is also applicable to an edged tool, a tablet-forming punch, a precise machine part and the like.

The invention claimed is:

1. A stainless steel having a high hardness and excellent mirror-finished surface property, consisting essentially of, by mass, from more than zero to not more than 0.01% C (carbon), from 1.5 to less than 3.0% Si, from 0.05 to 0.8% Mn, 6.0 to 12.0% Cr, 4.0 to 10.0% Ni, from more than zero to not more than 10.0% Co, from more than zero to not more than 6.0% Cu, 1.0 to 3.0% Ti, from 0.07 to not more than 2.0% Al, optionally at least one element selected from the group consisting of three elements of not more than 1.0% Nb, not more than 1.0% Ta and not more than 0.1% Zr, less than 0.4% Mo, up to the limit of 0.01% N (nitrogen), and Fe and unavoidable impurities.

2. The stainless steel according to claim 1, wherein the Si content is from 2.0 to less than 3.0 mass %.

3. The stainless steel according to claim 1, which has a hardness of not less than HRC 59.

4. The stainless steel according to claim 2, which has a hardness of not less than HRC 59.

5. A method of producing a stainless steel having a high hardness and excellent mirror-finished surface property, which comprises the steps of:

preparing a casting of the stainless steel obtained by a consumable electrode re-melting process, the stainless steel consisting essentially of, by mass, from more than zero to not more than 0.01% C (carbon), from 1.5 to less than 3.0% Si, from 0.05 to 0.8% Mn, 6.0 to 12.0% Cr, 4.0 to 10.0% Ni, from more than zero to not more than 10.0% Co, from more than zero to not more than 6.0% Cu, 1.0 to 3.0% Ti, from 0.07 to not more than 2.0% Al, optionally at least one element selected from the group consisting of three elements of not more than 1.0% Nb, not more than 1.0% Ta and not more than 0.1% Zr, less than 0.4% Mo, up to the limit of 0.01% N (nitrogen), and Fe and unavoidable impurities; and subjecting the casting to a solution treatment at a temperature of 1,000 to 1,150° C., and an aging treatment at a temperature of 400 to 550° C.

6. The method according to claim 5, wherein stainless steel after the heat treatment has a hardness of not less than HRC 59.

* * * * *